US005440811A

United States Patent [19]

Challis

[11] Patent Number: 5,440,811

[45] Date of Patent: Aug. 15, 1995

[54] ADJUSTABLE/INDEXABLE SCRAPING TOOL

[75] Inventor: Brian Challis, Sandy, Utah

[73] Assignee: L. J. Smith, Inc., Bowerston, Ohio

[21] Appl. No.: 180,039

[22] Filed: Jan. 11, 1994

[51] Int. Cl.[6] ..... B26B 1/04

[52] U.S. Cl. ..... 30/169; 30/351; 30/353

[58] Field of Search ..... 83/955; 30/169, 57, 30/167.1, 346/57, 346.61, 351, 353

[56] References Cited

U.S. PATENT DOCUMENTS

| | | | |
|---|---|---|---|
| 891,871 | 6/1908 | Smith | 30/169 |
| 925,259 | 6/1909 | Ziegler | 30/169 |
| 1,027,676 | 5/1912 | Vonderacek | 30/169 |
| 1,527,561 | 2/1925 | Klum | 30/169 |
| 2,226,794 | 12/1940 | Williams | 30/169 |
| 2,257,314 | 9/1941 | Shinn, Jr. | 30/169 |
| 2,599,193 | 6/1952 | Morris | 30/169 |
| 2,630,591 | 3/1953 | Smith | 30/169 |
| 3,261,095 | 7/1966 | Nelson et al. | 30/169 |

*Primary Examiner*—Kenneth E. Peterson

*Attorney, Agent, or Firm*—Thorpe North & Western

[57] ABSTRACT

A hand held scraping tool for scraping across a work surface includes an elongate handle and a mounting body connected to a distal extremity of said handle by an arched neck member. The mounting body includes a substantially planer mounting surface with at least one positioning peg and a male threaded mounting screw extending axially outward therefrom. A scraping blade is placed against the mounting surface such that the positioning peg and mounting screw pass through apertures formed in said scraping blade to retain said scraping blade in a seated position. The scraping blade includes a plurality of scraping edges. A locking collar having a centrally located, female threaded hole therein screws onto the mounting screw to thereby sandwich the scraping blade between the mounting surface and said locking collar and thus retain the scraping blade in a secured position. The locking collar is selectively releasable/lockable to provide the advantage of allowing a user to rotate the scraping blade a certain amount to thereby align any one of the plurality of scraping edges with the work surface.

10 Claims, 2 Drawing Sheets

ADJUSTABLE/INDEXABLE SCRAPING TOOL

BACKGROUND OF THE INVENTION

1. The Field of the Invention

The present invention concerns an adjustable, hand held scraping tool for scraping across a rigid surface, especially a non-planer surface, to shave and prepare said surface for a final treatment.

2. The Background Art

It is often desirable to thoroughly or selectively shave the surface of rigid workpieces. A surface shaving treatment can be performed to alter the shape of the workpiece, remove unwanted material from the workpiece, and/or improve the adherence and appearance of preliminary and final coatings on the workpiece. For example, in refinishing a wooden workpiece, a worker may wish to remove some or all of any glues, primers, or paints thereon with a preliminary shaving or sanding treatment before staining, painting or otherwise coating the surface.

In the case of a splintery wooden workpiece, a worker may want to remove part or all of the surface itself. It may also be desirable to round the corners of a workpiece. Where two or more workpieces abut each other at a joint, a worker may want to shave down one of the surfaces so that the joint is a smooth transition between the workpieces. Shaving and sanding treatments are more difficult to perform when the surface to be treated includes design grooves, ridges or other non-planer structure. Of current interest are hand-held devices for mechanically shaving generally rigid, non-planer surfaces on a workpiece.

It is often important when preparing a work surface for a final coating to uniformly scrape all portions of the surface without unduly wearing off some portions. However, this is often difficult to do when the work surface includes hard-to-reach grooves and crevices which require extra effort to scrape. It is therefore desirable to simultaneously shave some or all points on a non-planer surface with a single scraping motion.

Scrapers with handles offer enhanced gripping action and leverage, but some scraping needs are better accomplished by a scraper that is removable from the cumbersome handle. Other scraping needs involve contoured surfaces to be scraped which are positioned at varying angles relative to the worker and therefore require the worker to adjust the position of a scraping edge. Further, it is desirable to maintain a sharp scraping edge which can be quickly and easily sharpened.

There is thus a need to achieve a single apparatus useful for shaving an irregularly shaped or otherwise non-planer work surface with a scraping edge that can be adjusted and removed, and quickly and easily sharpened with a simple sharpener. There is also a need for such a device which provides a range of light to heavy-duty shaving action, is easy to use and relatively inexpensive to make. There is a further need for such a device which allows the user to avoid reducing or removing portions of the work surface during scraping. Those having ordinary skill in the art will appreciate that these and other needs are met by the present invention.

OBJECTS AND SUMMARY OF THE INVENTION

It is therefore an object of the present invention to provide an inexpensive scraping tool which provides a range of light to heavy-duty shaving action.

It is a further object of the invention to provide such a scraping tool which can simultaneously scrape across at least a portion of a non-planer work surface in a single scraping motion.

It is an additional object of the invention to provide such a scraping tool capable of concentrating the scraping force into a higher force per surface area of contact.

It is also an object of the invention to provide such a scraping tool in which the operative part of the tool for scraping is interchangeable with other operative parts having a different form.

It is another object of the invention to provide such a scraping tool wherein a scraping edge thereof is rotatably adjustable.

It is still another object of the invention to provide such a scraping tool wherein a scraping edge thereof is reversibly adjustable.

The above objects and others not specifically recited are realized in a specific illustrative embodiment of a hand-held scraping tool for scraping along a generally rigid surface. The device includes a handle and a mounting body extending outward from a distal end of said handle, the mounting body including a substantially planer mounting surface. A scraping blade having one or more customized scraping edges is placed against the mounting surface and secured in a seated position thereon by a male screw member and at least one positioning peg which extends axially outward from the mounting surface through positioning apertures formed within said scraping blade. A locking collar having a female threaded hole therein screws onto the screw member to sandwich the scraping blade between said locking collar and the mounting surface and thereby retain the scraping blade in a secured position.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION

Figure 1:
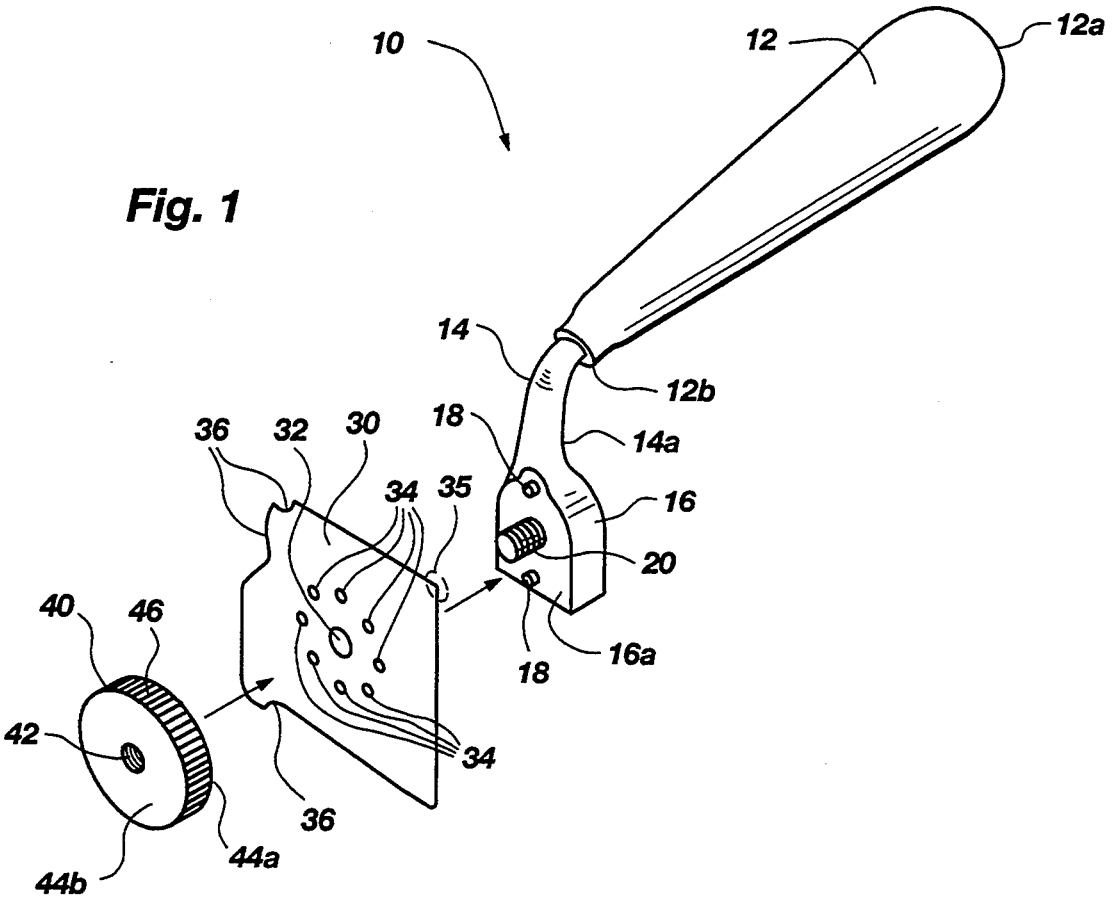
FIG. 1 is an exploded, perspective view of a scraping tool made in accordance with the principles of the present invention.
Figure 2:
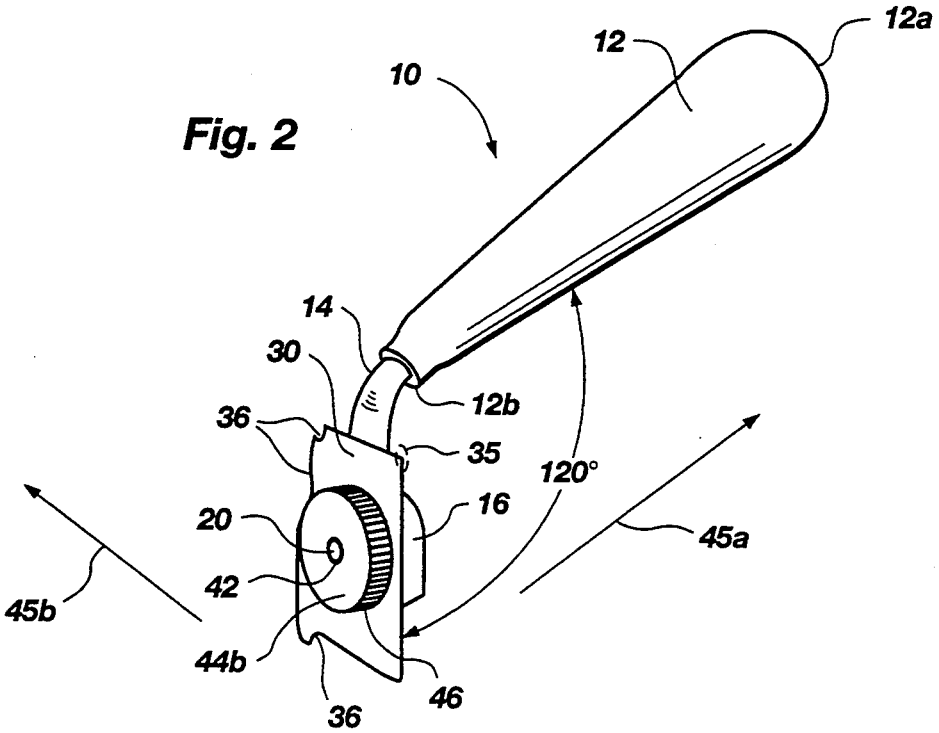
FIG. 2 is an assembled, perspective view of the scraping tool of FIG. 1.

A preferred embodiment in accordance with the present invention is illustrated in FIGS. 1–2. Referring now to FIGS. 1–2, there is shown a scraping tool, generally designated at 10. The tool 10 includes an elongate handle 12 having proximal and distal extremities 12*a* and 12*b*, respectively. A neck member 14 extends outward from said distal extremity 12*b*, and includes a distal neck end 14*a*. A mounting body 16 is integrally connected to the distal neck end 14*a*, said mounting body having a substantially planer mounting surface 16*a*. Positioning pegs 18 and a male mounting screw 20 extend axially outward from the mounting surface 16*a* in substantial parallel alignment with each other, said pegs 18 being positioned equidistantly from said screw 20.

Figure 3:
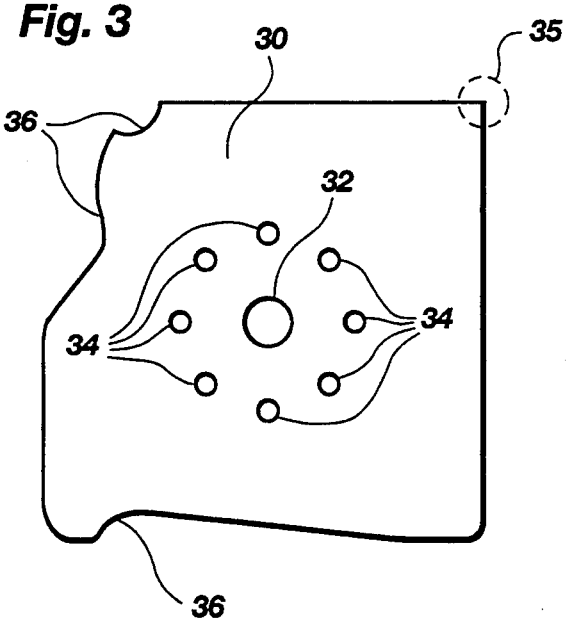
FIG. 3 is a plan view of a scraping blade of the scraping tool of FIGS. 1–2.

A separate scraping blade 30 includes a mounting aperture 32 and a circular array of positioning apertures 34 surrounding said mounting aperture 32. The scraping blade 30 includes curvilinear, customized scraping edges 36 formed thereon. FIG. 3 shows a plan view of the scraping blade 30 to more clearly and concisely illustrate the features thereof. The scraping blade 30 is preferably planer.

Figure 4:
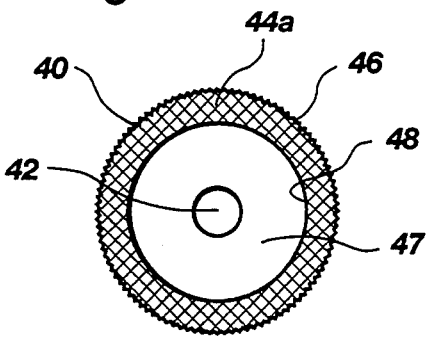
FIG. 4 is a plan view of a locking collar of the scraping tool of FIGS. 1–2.
Figure 4A:
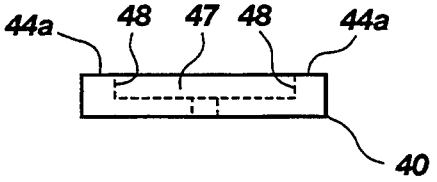
FIG. 4A is a side view of the locking collar of FIG. 4.

A separate locking collar 40 comprises a disk-type member having a female-threaded hole 42 located substantially centrally therein for twisting onto the screw 20. The hole 42 can be a passage or a cavity closed off on one side. The locking collar 40 includes first and second opposing faces 44*a* and 44*b*, and a knurled or otherwise textured perimeter surface 46 to enhance gripping of said locking collar 40. FIG. 4 shows a plan view of the locking collar 40 to more clearly and concisely illustrate the features thereof, including an annular recess 47 formed in the first opposing face 44*a* and defined by an annular lip wall 48.

An advantage of the present invention is that a number of different scraping blades 30 can be designed and used with the tool 10, each blade having differently shaped scraping edges 36. Scraping blades can be custom designed so that their scraping edges 36 match the surface contours of a plurality of work surfaces to be scraped.

The purpose and interrelationship of the elements identified above will be discussed in more detail below.

A user assembles the scraping tool 10 by first selecting a scraping blade 30 which matches the contour of a surface to be scraped. For example, if the user desired to scrape the outer surface of a stair railing, a scraping blade 30 would be selected having a scraping edge 36 matching or approximating said railing surface.

Referring to FIG. 1, the user places the scraping blade 30 flush against the mounting surface 16a in the direction shown, such that the screw 20 passes through the mounting aperture 32 and the positioning pegs 18 pass through corresponding positioning apertures 34 to hold the blade 30 in place in a seated position. The user then places the locking collar 40 onto the screw 20 in the direction shown with the first opposing face 44*a* facing the mounting blade 30. The locking collar 40 is rotated to thereby engage said locking collar 40 with the male screw 20 until the scraping blade 30 is sandwiched between the locking collar 40 and the mounting surface 16*a*. The scraping blade 30 is thereby retained in a secured position. The positioning pegs 18 are received within the annular recess 47 of the locking collar 40 to thereby permit the first opposing face 44*a* to abut the scraping blade 30. It is to be understood that alternative embodiments can be made to include only a single positioning peg 18, or more than two such positioning pegs, although two pegs 18 are preferred. Many other embodiments are possible, including a smaller locking collar 40 which can fit between the pegs 18, obviating the need for the annular recess 47.

The user utilizes the scraping tool 10 by grasping the proximal extremity 12*a* of the handle 12 in the palm of the hand and positioning a scraping edge 36 against a work surface. The user pulls the tool 10 rearwardly toward himself or herself in the direction of arrow 45*a* in FIG. 2 to thereby scrape the surface. The tool 10 can also be pushed outward from the user in a direction 45*b* to scrape the surface. Numerous other grasping and working positions are possible in addition to those described.

Figure 5:
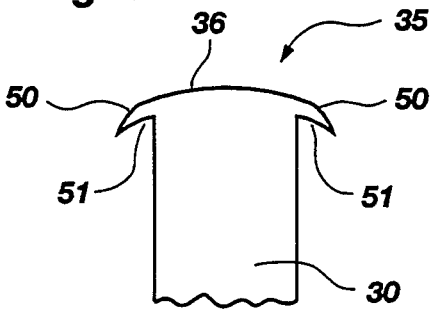
FIG. 5 is an enlarged, side view of the scraping blade of FIGS. 1–3.

FIG. 5 illustrates an enlarged, side view of a portion of the scraping blade 30. The corners defining the scraping edges of the blade 30 are very small hook shapes 50. These hook shapes 50 can be microscopic and extend laterally outward from the blade 30 to form crevices 51. It will be appreciated that normally only one of the hook shapes 50 will be used at a time. The hook shapes 50 permit enhanced scraping action by providing a narrower contact surface and thereby increasing the force per unit area transferred through the blade 30, as more fully explained below. The advantage of the hook shapes 50 is obtained by drawing the tool 10 across the work surface such that the blade 30 moves at an angle relative to the work surface, with the crevice 51 of the cutting shape 50 facing the direction of movement of the blade 30. It is thus preferable, when pushing the tool 10 in the direction 45*b*, that the user tilt the tool 10 to angle the blade 30 away from the user to more fully utilize the cutting hook shape 50.

It is preferred that the scraping blade 30, when assembled, be positioned at an obtuse angle relative to the handle 12 within a range of approximately 100 degrees to 140 degrees. The preferred angle is approximately 120 degrees as shown in FIG. 2. This positional relationship is particularly advantageous when a user is facing the work surface to be scraped, and causes at least two significant mechanical phenomena to occur:

(1) The scraping force is concentrated into a higher force per surface area of contact. This occurs because the operational scraping edge 36 is propelled along the work surface at an inclined position to cause one of the hook shapes 50 to cut into the work surface. With the operational scraping edge 36 inclined relative to the work surface, the only surface area of contact is a hook shape 50 of said operational scraping edge 36, and all of the scraping force is thus transferred from said hook 50 into the material to be scraped. This has the effect of increasing the force per surface area of contact, resulting in a much higher, concentrated scraping force as compared to a scraping blade positioned substantially perpendicular to the work surface with the entire edge 36 in contact therewith. This increases the cutting action substantially uniformly along the operational hook 50.

(2) The strength of the fingers and the palm of the user are more effectively utilized. The unique positional relationship between the handle 12 and the assembled scraping blade 30 is such that a user who grasps the handle 12 in the palm and pulls the tool 10 rearwardly across a work surface in the direction 45*a* shown in FIG. 2 is gripping and pulling with the fingers, and pressing down with the palm. However, a user who grasps a substantially straight handled scraper (i.e. 180 degrees between handle and scraping blade) must use the fingers to grip, pull and press down, while the palm goes underutilized. The present invention thus optimizes the strength of the user and the transfer of the scraping force in conjunction with a customized scraping edge 36 to provide highly effective scraping action across a non-planer surface in a single scraping motion. Increased force and/or control can be applied by pressing on the locking collar 40 and scraping blade 30 with the other hand. Further, the angular relationship of handle 12 and blade 30 enables the blade 30 to be presented to the work surface at a variety of angles. This enables optimal positioning of the hook edge 50 and in a manner which modifies the projected form of the blade.

It is to be understood that the mechanical phenomena discussed above can occur at any positional angle between the scraping blade 30 and the handle 12, either obtuse or acute. It is however preferred that the scraping blade 30 be positioned at approximately 120 degrees from the handle 12.

A principal aspect of the invention is the adjustability of the scraping blade 30. The locking collar 40 can be selectively screwed onto, and unscrewed from, the mounting screw 20. The selectively releasable/securable locking collar 40 combines with the circular array of positioning apertures 34 to allow the user to selectively disengage said apertures 34 from the pegs 18, remove the blade 30 and replace it back onto the mounting surface 16*a* in an incrementally rotated, adjusted position. This allows the user to tailor the fit of the tool 10 against the surface to be scraped to suit his or her individual grip or to adapt to a confining environment. The rotatable adjustability of the scraping blade 30 also allows the user to align any one of said scraping edges with the work surface. The blade 30 is also reversibly adjustable in that it can be flipped over if desired in order to position said blade for scraping with the other hand for scraping a mirror-image surface, and so forth. It is thus seen that the positioning pegs 18, the mounting screw 20, and the locking collar 40 are disposed on the mounting surface 16*a*, and co-act to releasably secure the scraping blade in a plurality of rotated positions about its center.

It is also within the scope of the present invention to provide for continuous rotatability of the scraping blade 30, instead of incremental rotatability. The positioning apertures 34 would simply be omitted, as would the positioning pegs 18, to allow 360 degree rotation and positioning of the scraping blade 30. The scraping blade 30 would be rotatably adjustable by simply loosening somewhat the locking collar 40, rotating the scraping blade 30, and re-tightening said locking collar.

The scraping edges 36 preferably comprise a durably stiff, metallic edge. It will be appreciated that the scraping tool 10 is useful for scraping across a plurality of points along a non-planer work surface with a single scraping motion given the custom fit of the scraping edges 36. Moreover, the secure, sandwiched fit of the scraping blade 30 between the mounting surface 16*a* and the locking collar 40, coupled with the stiffness of the edges 36 permits a broad range of light to heavy duty scraping action with significant user control. This combination of features allows the user to maneuver the tool 10 along a work surface using hand-eye coordination to scrape only extraneous wood, glues, paints, and so forth from said work surface without abrading the original or desired material thereunder.

A preferred environment for use of the present invention thus includes rigid, non-planer work surfaces. However, it is to be understood that the utility of the present invention extends to all types of work surfaces, including planer work surfaces. The simple design of the scraping tool 10 permits economy of manufacture and easy operation. The interchangeable nature of the scraping blade 30 permits customized scraping edges 36 of many shapes and sizes, thereby enabling a user to quickly and efficiently scrape a variety of surfaces as needed.

The scraping blade 30 is preferably fabricated from hardened steel suitable for holding a sharp edge, but may alternatively be fabricated from any other material suitable for scraping. The handle 12 is preferably made from wood or plastic suitable for gripping since wood is warm to the touch, as opposed to metal. The remaining structural features of the tool 10, including the neck 14, mounting body 16, positioning pegs 18, mounting screw 20, and locking collar 40 are preferably made of any metal suitable for the functions required. The handle 12, neck 14, mounting body 16, positioning pegs 18 and mounting screw 20 are preferably separate components which are assembled in the configuration shown in FIGS. 1–2. However, the tool 10 may alternatively comprise a unitary piece of continuous material formed in the shape of the interconnected structures of the handle 12, neck 14, mounting body 16 positioning pegs 18 and mounting screw 20. Further, the handle 12, neck 14 and mounting body 16 can collectively be formed as a single, unitary member, with the positioning pegs 18 and mounting screw 20 attached thereto at a later time.

The mounting screw 20 can include for example, a hexagonal recess 21 as shown in FIG. 1 for installing, removing and tightening the screw 20 into the mounting body 16. It will be appreciated that a user may wish to replace the mounting screw 20 due to wear and tear of the threads or for some other reason. Accordingly, the mounting screw 20 can be removably screwed into an internally threaded bore (not explicitly shown) formed within the mounting surface 16*a*. A user may simply remove said mounting screw 20 by placing a hexagonal key or its equivalent into the recess 21 to rotate the screw 20 out of the mounting body 16 and replace said screw 20 with a new mounting screw. This interchangeability extends the life of the tool 10 and thus the affordability thereof. The positioning pegs 18 may also be interchangeably installed as desired, as well as any of the separate components of the tool 10 discussed herein.

Figure 6:
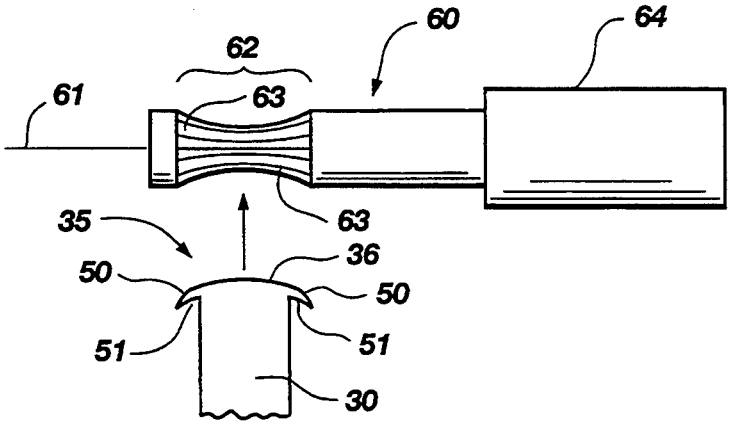
FIG. 6 is a side view of a former/sharpener of the scraper tool.

Another principle aspect of the present invention is a special scraper sharpener 60 (see FIG. 6) specifically adapted to produce and maintain the hook shapes 50 of the scraping blade 30. The sharpener 60 is preferably a cylindrical member of substantially uniform diameter except for a circumferential, annular recess 62 formed therein. The wall portion of cylindrical sharpener 60 which defines the recess 62 has an arcuate shape as shown and a generally rough surface 63. The rough surface 63 is preferably a series of parallel, longitudinal striations or cuts in the recess wall of the sharpener 60. The sharpener 60 is inserted into a rotating device 64, such as a drill, chuck or router, suitable for causing the sharpener 60 to rotate about its longitudinal axis 61.

The scraping blade 30 in an original form includes a blade having common, square corners (not shown). The blade 30 is moved into contact with the rotating sharpener 60 in the direction shown to burnish, roll and press the corners outwardly from the blade 30 into the barely visible hook shapes 50. The shape and rotational force of the rough surface 63 against the edge 36 thus cooperate to provide burnishing, rolling and pressing action uniquely adapted to form the corners into the hook shapes 50. When the hook shapes 50 become dulled from use, the sharpener 60 can be used in the same manner to sharpen, or re-form, the hook shapes 50. In effect, the sharpener 60 acts to both shape and sharpen the hook shapes 50. It will be appreciated that the hook shapes 50 formed by the sharpener 60 offer advantages over common square corners, including concentration of the scraping force as discussed above.

The burnishing effect of the surface 63 on the edge 36 of the blade 30 is similar to said edge 36 being pounded thousands of times by a tiny hammer. One advantage of the sharpener 60 is that it can be rotated in a drill, chuck or router at high speeds-at several thousand rpm or more—to shape and/or sharpen the hook shapes 50 very quickly. This saves time and avoids undue delay. Another advantage is the concavity of the annular recess 62, which enables both corners of the edge 36 to be burnished simultaneously.

The present invention represents a significant advance in the field of scraping apparatus. It is noted that many, but not all, of the advantages of the present invention accrue due to the combination of an interchangeable, customized scraper blade having a circular array of positioning apertures for incremental, rotational positioning. The problems associated with using two or more separate devices to effectively scrape a non-planer surface without undue wear thereof as discussed above are overcome to a significant degree by the present invention. The simplicity of manufacture and operation of embodiments of the present invention further adds to the advantages thereof. Those skilled in the art will appreciate from the preceding disclosure that the objectives stated above are advantageously achieved by the present invention.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. A hand-held scraping tool for scraping across a work surface comprising:

an elongate handle having a proximal extremity configured to be gripped in the hand of a user and a distal extremity which includes a mounting surface for supporting a scraping blade;

a scraping blade for placing onto the mounting surface, having at least one scraping edge configured for scraping across the work surface., wherein said blade includes a mounting aperture and at least one positioning aperture formed therein for receiving a mounting screw and a positioning peg, respectively; and means disposed on the mounting surface for releasably securing the scraping blade against said mounting surface in a plurality of different rotational positions of the scraping blade about a center thereof, comprising:

at least one positioning peg disposed on the mounting surface and extending axially outward therefrom;

a male threaded mounting screw disposed on the mounting surface and extending axially outward therefrom in substantial parallel alignment with the positioning peg, the positioning peg and mounting screw configured for insertion into the mounting aperture and said at least one positioning aperture, respectively, to thereby maintain the scraping blade in a seated position; and a locking collar including a female threaded hole formed therein for screwing said collar onto the mounting screw to thereby releasably sandwich the scraping blade between a face of the collar and the mounting surface in a secured position, said collar further including an annular recess formed in said face for receiving a remaining free end of the positioning peg.

2. A scraping tool as in claim 1 wherein said at least one scraping edge comprises a plurality of non-linear scraping edges, and wherein the means for securing the scraping blade against the mounting surface is selectively releasable/securable to permit a user to selectively rotate the scraping blade a certain amount to thereby align any one of said scraping edges with the work surface.

3. A scraping tool as in claim 1 wherein the scraping blade further comprises a substantially planar metal sheet having a circular array of positioning apertures formed therein around the mounting aperture, said mounting aperture being located substantially centrally within said circular array.

4. A scraping tool as in claim 1 wherein the distal extremity of the handle further comprises an arched neck member connecting the mounting surface to the handle such that the mounting surface is positioned at an obtuse angle with respect to said handle.

5. A scraping tool as in claim 4 wherein the value of the obtuse angle is within a range of approximately 100 degrees to 140 degrees.

6. A scraping tool as in claim 4 wherein the value of the obtuse angle is approximately 120 degrees.

7. A scraping tool as in claim 1 wherein the mounting surface is substantially planer.

8. A scraping tool as in claim 1 wherein said at least one positioning peg comprises two positioning pegs disposed on the mounting surface and extending axially outward therefrom such that said mounting pegs and the mounting screw are positioned in substantial parallel alignment common to an imaginary line.

9. A hand-held scraping tool for scraping across a work surface comprising:

an elongate handle having a proximal extremity configured to be gripped in the hand of a user;

a mounting body attached to a distal extremity of the handle and having a mounting surface for supporting a scraping blade;

at least one positioning peg disposed on the mounting surface and extending axially outward therefrom;

a male threaded mounting screw disposed on the mounting surface and extending axially outwardly therefrom in substantial parallel alignment with the positioning peg;

a scraping blade for placing onto the mounting surface, said scraping blade having a mounting aperture and at least one positioning aperture formed therein for receiving the mounting screw and the positioning peg, respectively, to thereby maintain the scraping blade in a seated position, said scraping blade further including at least one scraping edge configured for scraping across the work surface; and a locking collar including a female threaded hole formed therein for screwing said collar onto the mounting screw to thereby sandwich the scraping blade between a face of the collar and the mounting surface in a secured position, said collar further including an annular recess formed in said face for receiving a remaining free end of the positioning peg.

10. A scraping tool as in claim 9 wherein the scraping edge is defined by first and second opposing corners, at least one of said corners being formed into a hook shape for cutting into the work surface.

* * * * *